United States Patent [19]

Bardwell

[11] 4,440,245

[45] Apr. 3, 1984

[54] GRAVITY PERCUSSION DRILL WITH UPPER END COCKING SPRING AND METHOD OF ASSEMBLY

[76] Inventor: Allen E. Bardwell, P.O. Box 507, High Knob Estates, Front Royal, Va. 22630

[21] Appl. No.: 389,373

[22] Filed: Jun. 17, 1982

[51] Int. Cl.[3] ..... E21B 4/08

[52] U.S. Cl. ..... 175/293; 29/436; 175/299

[58] Field of Search ..... 175/293, 299–304; 173/102, 121; 29/434, 436, 526 R

[56] References Cited

U.S. PATENT DOCUMENTS

| | | | |
|---|---|---|---|
| 1,794,991 | 8/1929 | Stephan | 175/302 |
| 1,798,082 | 7/1928 | Grutzbach | 173/119 |
| 2,059,540 | 12/1930 | Stephan | 175/302 |
| 2,241,477 | 5/1941 | Rasmussen | 175/302 |
| 2,265,431 | 12/1941 | Kerr | 175/299 X |
| 2,371,248 | 3/1945 | McNamara | 175/299 X |
| 2,524,707 | 10/1950 | Koeln | 175/299 |
| 2,665,115 | 1/1954 | Bassinger | 175/299 X |
| 2,713,992 | 7/1955 | Snyder | 175/299 X |
| 2,738,956 | 3/1956 | Bielstein | 175/299 X |
| 2,742,263 | 4/1956 | Clugage | 175/56 |
| 2,742,265 | 4/1956 | Snyder | 175/299 X |
| 2,765,776 | 10/1956 | Pyk | 173/102 |
| 2,835,474 | 5/1958 | O'Connor et al. | 175/299 |
| 2,836,395 | 5/1958 | Bielstein | 175/299 |
| 2,872,158 | 2/1959 | Green | 175/299 |
| 2,998,087 | 8/1961 | Iddings | 175/152 |
| 3,215,212 | 11/1965 | Bardwell | 175/299 |
| 3,303,899 | 2/1967 | Jones, Jr. et al. | 175/299 |
| 3,409,091 | 11/1968 | Bardwell | 173/119 |
| 3,409,095 | 11/1968 | Bardwell | 175/299 |

*Primary Examiner*—Ernest R. Purser
*Assistant Examiner*—Thuy M. Bui
*Attorney, Agent, or Firm*—Quarles & Brady

[57] ABSTRACT

A multiple drill stem for cable tool drilling operations, in which the drill stem is repeatedly hoisted and dropped to impact, has an internal hammer that moves a short distance to strike an anvil in a lower end of a drill stem casing. The improvement relates to a cocking spring that is positioned along an uppermost portion of the hammer and away from harmful debris that collects where the hammer strikes the casing anvil. The casing bears against an upper hammer anvil to cock the spring between a spring-compressing flange at one end and a restriction in the casing interior that blocks an opposite end of the spring, but allows the hammer to slide through it. The spring is further compressed when the drill stem is dropped to a point of initial impact, so that the hammer strikes a follow-up blow on the lower casing anvil. A method of assembling the drill stem is also disclosed.

18 Claims, 8 Drawing Figures

GRAVITY PERCUSSION DRILL WITH UPPER END COCKING SPRING AND METHOD OF ASSEMBLY

BACKGROUND OF THE INVENTION

1. Field of the Invention

The field of the invention is percussion hammer drills, which are accelerated downward by the force of gravity, and which carry an internal hammer to strike additional blows shortly after an attached drill bit has first contacted the bottom of a hole.

2. Description of the Prior Art.

One type of percussion drilling is performed by cable drilling rigs with a drill string that is suspended from a steel cable to be lifted and then quickly released. A relatively heavy drill stem has an upper end coupled to the cable through a socket. The drill stem carries a steel or carbide-tipped drill bit at its lower end.

In my previous U.S. Pat. Nos. 3,215,212; 3,409,091 and 3,409,095, I have provided an internal hammer in the drill stem that acts against springs or other biasing means to strike a second blow shortly after the bit has first contacted the bottom of the hole being drilled. Whereas the first impact of the bit cuts into the rock or earth formation being drilled, the second impact increases the fragmentation of the material. Usually in drills of this type successive blows are caused by the rebounding of the internal hammer to produce a chattering effect.

While the prior art drill structures have performed reasonably well, there is need for drill stems with larger internal hammers. To be more specific, hammers in the form of a long cylindrical rod with a diameter of up to eighteen inches are desired. The hammer has an anvil at its lower end which strikes an anvil within the casing, and it is desirable to have anvil contact surfaces with the largest area possible in order to distribute the forces of impact and lower the stress in these elements.

The hammer in the gravity drill of U.S. Pat. No. 3,409,091 had two portions of reduced diameter for carrying a pair of springs, while the hammers in U.S. Pat. Nos. 3,409,095 and 3,215,212 had more than one portion of reduced diameter for other reasons that are apparent from their disclosures. For the large drills currently being contemplated, it would be advantageous to be able to provide a hammer of a large mass that fills an internal bore of the drill stem to the maximum extent possible, and require only a single such reduced portion.

Because the hammer is enclosed within the drill stem chamber and is subjected to strong impacts, a certain amount of metallic dust and debris accumulates in the closed interior. Such dust and debris can accumulate and clog the springs near the lower end of the drills of the prior art, thereby limiting the life of these tools. The prior tools were not constructed with a view to periodic maintenance, and maintenance required the inconvenient step of cutting open the casing. There was thus a need for a drill with longer life and better serviceability.

SUMMARY OF THE INVENTION

My invention resides in a multiple-blow gravity drill structure with an internal hammer that is supported by a cocking spring around its upper end. The spring is cocked against a device restricting the movement of the lower end of the spring. The location of the cocking spring at the upper end of the hammer removes it from the vicinity of a debris chamber around the lower end of the hammer, where powder and debris could eventually interfere with the operation of the spring and necessitate cleaning or replacement.

One embodiment of my drill includes an elongated tubular casing with an enclosed longitudinal bore, and with a lower anvil at the bottom end of the bore. A hammer is disposed within the bore for reciprocating movement therein, the hammer having an anvil at its lower end. A single spring is mounted within the bore for yieldably supporting the hammer by its upper end in a cocked position where the lower hammer anvil is spaced apart by a gap from the casing anvil at the lower end of the bore. Upon the dropping of the drill structure to a point of first impact the spring yields to allow the hammer to close the gap between the anvils and provide a follow-up impact through the lower end of the drill structure.

One object of the invention is to provide a novel and superior method to hold the internal hammer in a cocked position by locating the cocking spring along the upper end of the hammer rather than along a lower portion.

Another object of the invention is to provide the internal hammer with a larger lower anvil surface that is better able to withstand the heavy impacts experienced with large hammers.

Another object of the invention is to provide a drill stem with a larger portion of its weight contributed by its internal hammer.

Another object of the invention is to locate the cocking spring where it will not be subject to an accumulation of powder and debris that would cause the spring to limit the useful life or maintenance cycle of the tool.

Another object of the invention is to provide a means and method to allow cleaning of the internal hammer parts, especially its cocking spring.

Another object of the invention is to provide a method for more easily assembling a drill than has been known before this time.

The foregoing and other objects and advantages of the invention will appear in the following description, wherein reference is made to the accompanying drawings that form a part hereof, and in which there is shown by way of illustration preferred embodiments of the invention. These embodiments, however, do not necessarily represent the full scope of the invention, but are merely illustrative, and therefore reference is made to the claims at the end of the description for determining the scope of the invention.

DETAILED DESCRIPTION OF THE PREFERRED EMBODIMENT

Figure 1:
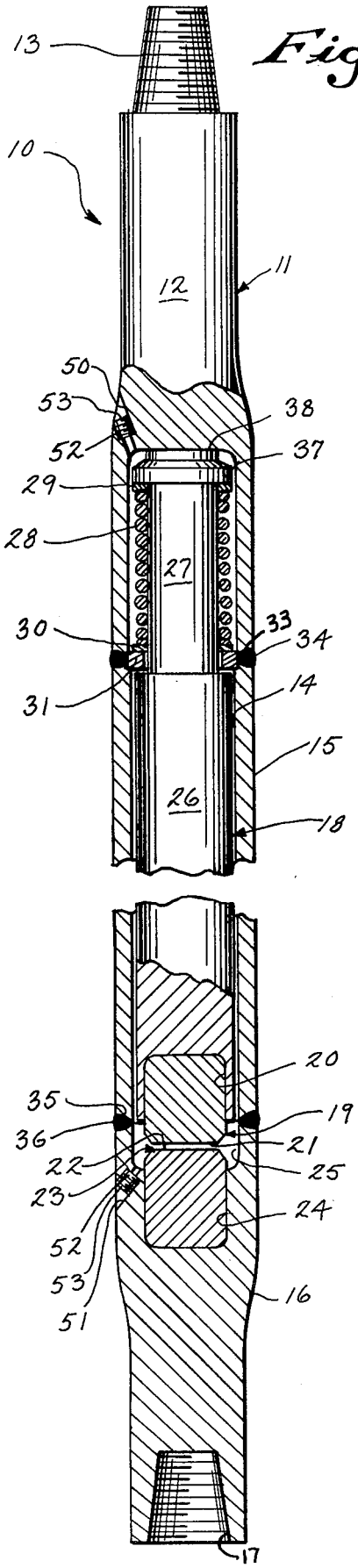
FIG. 1 is an elevational view of a percussion hammer drill of the multiple blow type that is constructed in accordance with the teachings of the present invention, with the casing being sectioned to illustrate the internal elements of the drill in a cocked position.

Referring to FIG. 1, a first embodiment of my drill stem 10 that incorporates the teachings of my invention has an elongated steel casing 11 which is assembled from three pieces that are welded together. A cap 12 at the upper end of the casing 11 is formed with a threaded and tapered upper tip 13 for coupling the drill stem 10 a cable drilling rig of a type well known in the art. The rig will lift the drill stem 10, which represents a relatively large mass, into a generally vertical position and then quickly release it so that it will fall rapidly under the force of gravity into the hole being drilled. This cycle is repeated at a typical rate of thirty to sixty times per minute. The drill stem 10 is lifted twenty-four to thirty-six inches and dropped from that height for each repetition.

The cap 12 has a downwardly opening cavity that forms the upper end of an enclosed longitudinal bore 14 extending through an elongated tube 15 in the middle of the casing 11 and into a shank 16 at the lower end of the casing 11. At the extreme lower end of the shank 16 is a downwardly opening threaded socket 17 for attachment to a threaded portion of a steel or carbide-tipped drill bit.

An elongated, cylindrical, steel hammer 18 extends almost the full length of the bore 14. A lower hammer anvil 19 of metal is press fit into a socket 20 at the lower end of the hammer 18. A shrink fit is obtained by heating the lower end of the hammer 18 before assembly and allowing it to cool after the anvil 19 has been inserted. The lower hammer anvil 19 projects downwardly from the lower end of the hammer 18 and is formed with a 45° bevel around the outer rim of a hardened contact surface 21. This surface 21 is opposed by a hardened upwardly facing contact surface 22 of equal area on a lower casing anvil 23. The lower casing anvil 23 is also made of metal and is fitted in a similar manner as the hammer anvil 19 into an upwardly opening socket 24 in the shank 16 of the casing 11, this socket 24 communicating with the lower end of the bore 14. While the preferred shape of the anvils 19 and 23 is cylindrical, their extending portions could be made of larger diameter than their seated portions to provide anvils with a T-shaped cross section. The two lower anvils 19 and 23 are of smaller diameter than the bore 14 and are spaced apart by a vertical gap that measures a fraction of an inch, and preferably in the range of ¼inch to ½inch. (This gap has been exaggerated in the drawings to aid the disclosure.) There is a portion of the bore 14 around the gap and between the lower end of the hammer 18 and the upwardly facing interior surface in the shank 16 that forms a debris chamber 25 where dust and debris from the repeated impacts of the metal members naturally tends to settle and accumulate.

Figure 2:
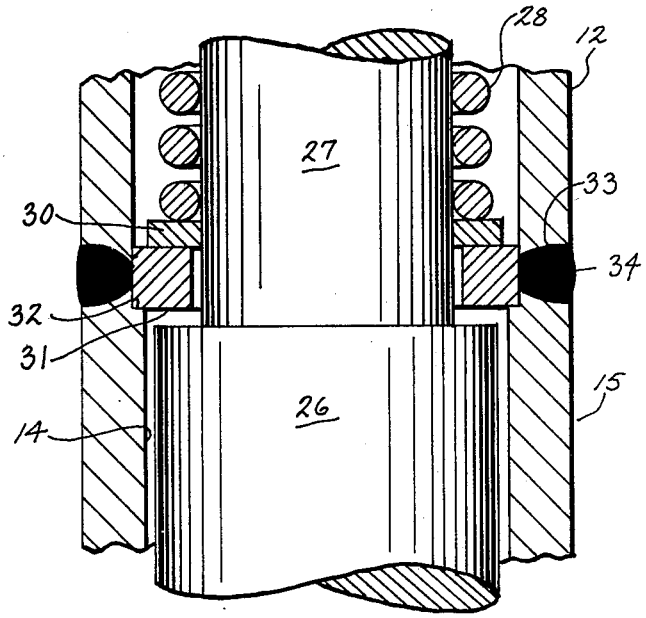
FIG. 2 is a detail view of the drill of FIG. 1 in the area where a casing cap is welded to a middle tubular section.

Still referring to FIG. 1, the hammer 18 has a neck 27 at its upper end with a diameter and cross section that are reduced from that of a hammer body 26. The neck 27 extends upwardly from the hammer body 26 for a distance of approximately sixteen inches. A compression cocking spring 28 is coiled around the hammer neck 27 and is seated between steel washers 29 and 30 at its top and bottom, the lower washer 30 being supported against downward movement by a spring restricting ring 31. As seen best in FIG. 2, this ring 31 is seated against an annular ledge 32 that is formed by a slight reduction in the diameter of the bore 14 leading into the top end of the casing tube 15. The lower end of the cap 12 and the upper end of the tube 15 are shaped to form a fillet 33 in which material 34 is received during a welding operation to join the two portions of the casing 11.

For the convenience of the disclosure, the drill stem 10 in FIG. 1 has been shown broken in the middle, but it should be understood that the casing tube 15 and the cylindrical hammer body 26 are about eighty-four inches long, whereas the cap 12 and the shank 16 are about forty-five and thirty inches long, respectively. From this it can be seen that the hammer body 26 is substantially longer than its other portions and this provides a large mass for the hammer 18. The diameter of the hammer body 26 in this embodiment is about seven inches, however, the construction disclosed herein may be applied to drills with hammer diameters up to eighteen inches.

Referring again to FIG. 1, the drill stem 10 is assembled by first fitting the lower anvils 19 and 23 into the receiving cavities 20 and 24 in the casing shank 16 and lower end of the hammer 18, respectively. The casing tube 15 is then welded at its lower end to the upper end of the shank 16, these portions of the casing forming a fillet 35 for receiving material 36 in the welding operation similar to the upper joint 15 in FIG. 2. The hammer 18 and its associated parts 27–31 are then assembled by first placing the restricting ring 31 over the neck 27 of the hammer and sliding it down to the shoulder of the hammer body 26. The lower washer 30, the cocking spring 28 and the upper washer 29 are slid over the neck 27 and an annular hammer flange 37 is then slipped over the neck 27 and pushed down about an inch where it is welded or pinned, or fastened by both means. This hammer flange 37 projects radially outward from the neck 27 to approximately the same perimeter as the hammer body 26 so that the cocking spring 28 can be retained between the flange 37 and the restricting ring 31. This assembly is then lowered into the casing tube 15 where the restricting ring 31 will be caught by the annular ledge 32. The casing cap 12 is then fitted over the hammer neck 27 until it engages a flat, blunt, upper tip of the neck 27 that serves as an upper hammer anvil 38. The cavity that forms the upper end of the bore 14 in the cap 12 is slightly shorter than the hammer neck 27. An external force is applied to press the cap 12 downward to meet the upper end of the casing tube 15 where they will be welded together. In pressing the cap 12 downward, the force is transmitted through elements 38 and 37 to the upper end of the cocking spring 28, to compress it a preselected amount against the opposition of the restricting ring 31, which is restricted against further movement down the bore of the casing tube 15. The spring 28 is then in its "cocked" position.

The cocking spring 28 has a rate of compression such that the gap between the lower anvils 19 and 24 is maintained when the hammer 18 is at rest or being lifted upward. When the drill stem 10 is dropped a vertical distance into the hole, the force of gravity causes the drill stem 10 to accelerate, which in turn causes the drill stem 10 to build up an amount of kinetic anergy. When the drill bit and drill stem 10 impact the bottom of the hole, energy is transmitted through the casing 11 and the restricting ring 31. This further compresses the cocking spring 28 and allows the hammer to continue its downward movement until its lower anvil 19 strikes the lower anvil 20 of the casing 11 for a follow-up impact. A reaction from this impact will cause the hammer 18 to rebound so that its upper anvil 38 will strike an interior surface in the casing cap 12. Several rebounding and reciprocating blows may be struck by the hammer 18 until the energy attained during its drop is dissipated.

By locating a single locking spring 28 as far away as possible from the lower end of the relatively long hammer 26, the problem of accumulation of dust and debris that would interfere with the opertion of the spring has been eliminated. This arrangement also permits a greater proportion of the weight of the drill stem to be allocated to the hammer 26, because the space required for the spring 28 has been minimized, thereby allowing the size of the hammer 26 to be maximized.

Figure 6:
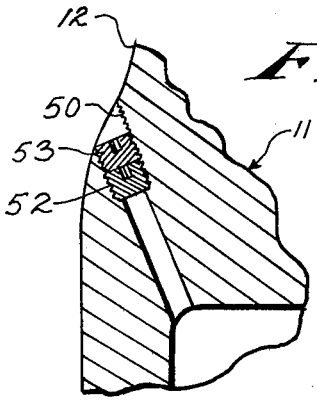
FIG. 6 is a detail view of a cleaning port in the casings shown in FIGS. 1 and 3.

Referring to FIG. 1, the casing cap 12 is formed with an entry port 50 slanting downwardly into the upper end of the bore 14 and the casing shank 16 is formed with an exit port 51 slanting upwardly into the lower end of the bore 14. The ports 50 and 51 are closed during drilling operations and periodically opened for cleaning out the accumulated metallic dust and debris in the lower end of the bore 14. Referring to FIG. 6, the closure means for each port 50 and 51 is provided by a pair of threaded Allen head plugs 52 and 53 which are inserted into and retained in a counterbored and threaded portion of each port 50 and 51. During cleaning operations this closure means is removed from both ports 50 and 51. A pressurized cleaning fluid is introduced at the entry port 50 and is flushed through the bore 14 and out the exit port 51 to carry the accumulated debris out of the interior of the drill stem 10. Compressed air can then be introduced at the entry port 50, if necessary, to dry the parts in the interior of the drill stem 10. In comparison with this easy efficient manner of cleaning, prior drill stems were often cut open and their casing rewelded after cleaning or maintenance.

Figure 3:
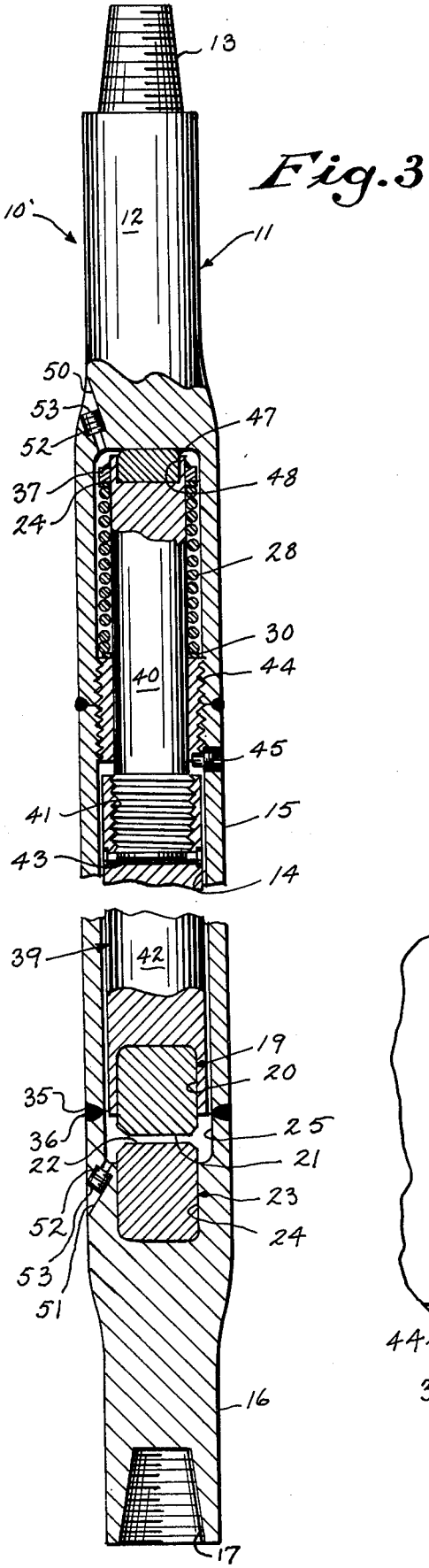
FIG. 3 is an elevational view of the same type as FIG. 1 for a second embodiment of the invention in which the internal construction of the hammer drill has been modified.
Figure 4:
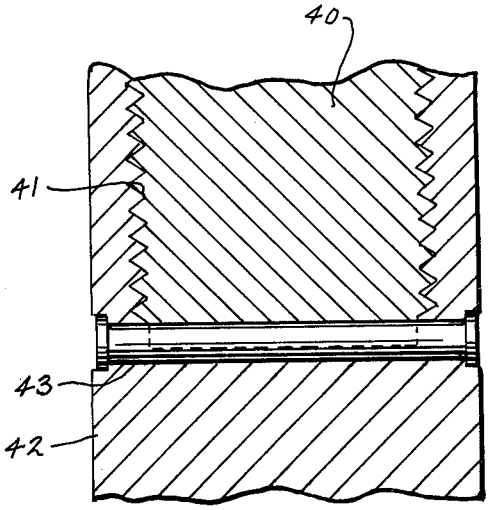
FIG. 4 is a detail sectional view showing the connection of the two pieces of the hammer in FIG. 3.
Figure 5:
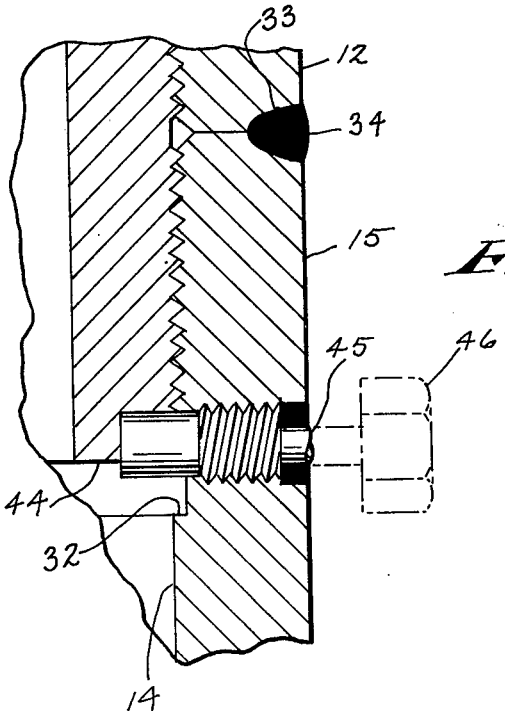
FIG. 5 is a detail view of a coupling seen in FIG. 3.

Referring to FIGS. 3–5, there is shown a second embodiment 10', which has some of the same components as the first, as shown by identical reference numbers. The differences are as follows. The hammer 39 is formed in two main pieces, the hammer neck 40 having a threaded end that is screwed into an upwardly opening threaded socket 41 in the hammer body 42. A pin 43 is staked on both ends as seen in FIG. 4 in a diametrical groove in the lower end of the hammer neck 40 to prevent the neck 40 from rotating after it is screwed into the hammer body 42. In this embodiment the restricting ring 44 is somewhat longer and has an outer threaded surface that mates with an interior threaded surface in the bore 14. Part of the interior threaded surface is formed at the lower end of the cap 12 and the other part is formed at the upper end of the tube 15. As seen in FIG. 5, a threaded pin 45 penetrates the casing tube 15 into the bottom end of the restricting ring 44 to prevent it from rotating. The pin 45 has a knock-off hex head 46 which is indicated in phantom. In this embodiment the restricting ring 44 also acts as a coupler so that when the casing is being assembled, the cap 12 can be first screwed onto the tube 15 and then welded as described for the assembly for the first embodiment. Another modification in the second embodiment is the provision of a separate upper anvil 47, which fits in a socket 48 in the top end of the hammer neck 40, in a manner similar to that described above for the lower anvil 20.

This description has been by way of example and the invention is to be viewed in somewhat broader terms as I have expressed it in the following claims.

I claim:

1. A multiple-blow gravity drill structure for carrying a drill bit, the drill structure comprising:

an elongated tubular casing wiht an enclosed longitudinal bore and with an anvil at the lower end of the bore;

a hammer disposed in the bore and of shorter length than the bore for reciprocating movement therein, the hammer having a lateral projection near its upper end and an anvil at its lower end;

a restriction within the bore towards the upper end of the hammer, the restriction allowing the hammer to slide by; and a spring with one end supported by the restriction within the bore and with an opposite end supporting the hammer by its lateral projection in a position where the spring is cocked against the restriction by a portion of the casing that is urged against the upper end of the hammer and where the anvil at the lower end of the hammer is spaced apart by a gap from the anvil at the lower end of the bore, the spring yielding upon the dropping of the drill structure to a point of initial impact to allow the hammer to close the gap between the anvils and provide a follow-up impact through the lower end of the drill structure.

2. The drill structure of claim 1, wherein the hammer has an upper portion of reduced cross section between a lower, body portion and the lateral projection near the upper end of the hammer;

wherein the spring is coiled around this upper portion of reduced cross section and supports the hammer by its lateral projection; and wherein the restriction includes a ring around the upper portion of reduced cross section and at the lower end of the spring, the ring being restricted against downward movement with the hammer so that the spring is cocked.

3. The drill structure of claim 2, wherein the ring is a piece separate from the casing.

4. The drill structure of claim 1, wherein the hammer includes an upper hammer anvil that bears against an interior surface of the casing when the hammer is in its cocked position.

5. The drill structure of claim 1, wherein the hammer anvil is a separate piece that is inserted into a cavity in the lower end of the hammer.

6. The drill structure of claim 1, wherein the casing anvil is a separate piece that is inserted into a cavity in the casing that communicates with the lower end of the bore.

7. The drill structure of claim 1, wherein the casing is forming with upper and lower entry ports into the upper and lower ends of the bore to allow passage of a pressurized cleaning fluid into and out of the interior of the drill structure, and wherein removable closure means are inserted to seal the ports for drilling operations.

8. A multiple-blow gravity drill structure comprising:

an elongated casing with a longitudinal enclosed bore, the casing having means at its upper end for attachement to a lifting and dropping cable tool apparatus so that the casing will hang in a generally vertical position, the casing also having means at its lower end for detachably holding a drill bit, and the casing having an upwardly facing lower casing anvil in its lower end that projects upwardly into the lower end of the bore;

a hammer disposed within the bore for reciprocal movement within the casing, the hammer having an elongated cylindrical body with a downwardly facing lower hammer anvil opposed by the upwardly facing lower casing anvil, the hammer also having a neck of relatively shorter length and reduced cross section compared to the body, the neck extending upwardly from the body, the neck having a flange around its upper end and the neck having means at its upper end for being pressed down by a portion of the casing that cocks the hammer;

spring opposition means disposed in the bore around the neck of the hammer to allow the hammer to slide therethrough, the spring opposition means being restricted against movement in the direction in which the force of gravity pulls the hammer; and a cocking spring compressed between the flange on the hammer and the spring opposition means when the hammer is cocked against the casing, the cocking spring having a rate of compression holding the lower hammer anvil off the lower casing anvil when the hammer is cocked, while allowing the spring to yield sufficiently when the drill structure is dropped to a point of impact so that the lower hammer anvil will provide a follow-up blow against the lower casing anvil shortly after the drill bit on the lower end of the casing has struck an initial blow.

9. The drill structure of claim 8, wherein only a single cocking spring is used.

10. The drill structure of claim 8, wherein the spring opposition means threadingly engages a thread within the bore and is pinned to prevent rotation.

11. The drill structure of claim 8, wherein the thread engagement of the spring opposition means and the casing extends above and below a weld joining a cap section of the casing to a tubular section.

12. The drill structure of claim 8, wherein the lower hammer anvil is a separated piece that is inserted into a cavity in the lower end of the hammer body.

13. The drill structure of claim 8, wherein the lower casing anvil is a separate piece that is inserted into a cavity in the casing that commuicates with the lower end of the bore.

14. The drill structure of claim 8, wherein the means at the upper end of the neck is an upper hammer anvil that contacts an interior surface of the cap portion of the casing when the cocking spring is in its cocked position.

15. The drill structure of claim 8, wherein a first washer is trapped between the flange and the upper end for coil lifting spring and a second washer is trapped between the retaining means and the lower end of the cocking spring.

16. The drill structure of claim 8, wherein the length of the hammer body is at least twice the length of its neck.

17. The drill structure of claim 8, wherein the casing is formed with upper and lower entry ports into the upper and lower ends of the bore to allow passage of a pressurized cleaning fluid into and out of the interior of the drill structure, and wherein removable closure means are inserted to seal the ports for drilling operations.

18. A method of assembling a multiple-blow gravity drill stem, the method comprising:

forming a hammer assembly by positioning a spring restricting member on a reduced upper portion of an elongated hammer having anvils at its upper and lower ends, the spring restricting member being slidable along the reduced portion of the hammer until meeting a portion of the hammer of full cross section, positioning a cocking spring on the reduced upper portion of the elongated hammer above the spring retaining member, and mounting a spring retaining member on the reduced upper portion of the elongated hammer above the cocking spring;

inserting the hammer assembly into a lower portion of a casing for the drill stem in which a ledge is formed by a reduction in the cross section of a casing bore to restrict the depth of insertion of the restricting member, the hammer being of smaller cross section than the bore so as to slide past the ledge;

pressing a casing cap onto the upper hammer anvil to cock the spring while moving the lower end of the cap downward to meet the upper end of the lower portion of the casing; and connecting the casing cap to the lower portion of the casing to close the hammer assembly within the bore, to hold the cocking spring in a cocked position in which the lower anvil of the hammer is spaced apart by a gap from an anvil at the lower end of the bore.

* * * * *

UNITED STATES PATENT AND TRADEMARK OFFICE

CERTIFICATE OF CORRECTION

PATENT NO. : 4,440,245

DATED : April 3, 1984

INVENTOR(S) : Allen E. Bardwell

It is certified that error appears in the above—identified patent and that said Letters Patent is hereby corrected as shown below:

In the Abstract, line 1, "multiple" should be --multiple-blow--.

Column 5, line 9, "locking" should be --cocking--.

Column 5, line 12, "opertion" should be --operation--.

Column 6, line 7, "wiht" should be --with--.

Column 6, line 56, "forming" should be --formed--.

Column 6, line 65, "attachement" should be --attachment--.

Column 7, line 43, "separated" should be --separate--.

Column 8, line 30, "retaining" should be --restricting--.

Signed and Sealed this

*Eleventh* Day of *September 1984*

[SEAL]

*Attest:*

GERALD J. MOSSINGHOFF

*Attesting Officer*

*Commissioner of Patents and Trademarks*